US007059096B2

(12) United States Patent
Kuebler et al.

(10) Patent No.: US 7,059,096 B2
(45) Date of Patent: Jun. 13, 2006

(54) MULTIFUNCTION UTILITY POLE

(75) Inventors: Ulrich Kuebler, Waterkii (CA); Antonio DeGasperis, Thornhill (CA)

(73) Assignee: Sky Cast Inc., Guelph (CA)

( * ) Notice: Subject to any disclaimer, the term of this patent is extended or adjusted under 35 U.S.C. 154(b) by 96 days.

(21) Appl. No.: 10/179,567

(22) Filed: Jun. 25, 2002

(65) Prior Publication Data

US 2003/0233806 A1 Dec. 25, 2003

(51) Int. Cl.
*E04C 3/30* (2006.01)
*F21S 13/10* (2006.01)

(52) U.S. Cl. ..... 52/726.4; 52/736.1; 52/169.9; 52/296; 362/431; 343/890; 174/45 R

(58) Field of Classification Search ..... 52/726.4, 52/736.1, 169.9; 362/431, 269; 174/45 R; 343/890, 790
See application file for complete search history.

(56) References Cited

U.S. PATENT DOCUMENTS

| | | | | |
|---|---|---|---|---|
| 825,627 | A | 7/1906 | Weeks | |
| 0,866,460 | A | 9/1907 | Haiss | |
| 0,890,033 | A | 6/1908 | Ellinger | |
| 0,965,729 | A | 7/1910 | Nickson | |
| 1,085,144 | A | 1/1914 | Massey | |
| 1,446,239 | A * | 2/1923 | Yumura | 362/431 |
| 1,777,509 | A * | 10/1930 | Underwood | 362/431 |
| 1,798,982 | A * | 3/1931 | Page | 52/723.1 |
| 2,596,495 | A | 5/1952 | Macerata | 72/0.5 |
| 2,912,849 | A | 11/1959 | Wissinger | 72/61 |
| 3,110,928 | A | 11/1963 | Engman | 18/5 |
| 3,242,252 | A * | 3/1966 | Bergenstein | 174/38 |
| 3,257,496 | A * | 6/1966 | Hamilton | 174/38 |
| 3,300,570 | A * | 1/1967 | Spiece et al. | 174/38 |
| 3,600,865 | A | 8/1971 | Vanich | 52/73 |
| 3,760,234 | A * | 9/1973 | Jones et al. | 361/666 |
| 3,862,411 | A * | 1/1975 | Persson | 362/431 |
| 4,166,347 | A | 9/1979 | Pohlman et al. | 52/233 R |
| 5,581,958 | A * | 12/1996 | Cote | 52/40 |
| 5,761,875 | A * | 6/1998 | Oliphant et al. | 52/721.2 |
| 5,820,255 | A * | 10/1998 | Carrington et al. | 362/431 |
| 6,167,673 | B1 * | 1/2001 | Fournier | 52/726.4 |
| 6,222,503 | B1 | 4/2001 | Gietema et al. | 343/890 |
| 6,303,857 | B1 * | 10/2001 | Ginsburg | 174/45 R |
| 6,398,392 | B1 * | 6/2002 | Gordin et al. | 362/431 |

* cited by examiner

*Primary Examiner*—Winnie Yip
(74) *Attorney, Agent, or Firm*—Vidas, Arrett & Steinkraus, PA

(57) ABSTRACT

A multifunction utility pole comprising a base portion suitable for installation in the ground or mounting on a surface, the base portion including a housing for a first utility, a pole portion extending above the base portion, the pole portion including a fixture for a second utility; and a wiring path extending through the base portion and the pole portion, to provide access for wiring to the second utility, wherein the utility pole is capable of simultaneously accommodating the first and second utilities.

21 Claims, 7 Drawing Sheets

MULTIFUNCTION UTILITY POLE

FIELD OF THE INVENTION

This invention relates to the general field of distribution of utility services, and more particularly to utility poles.

BACKGROUND OF THE INVENTION

Communication services such as telephone, cable television, and Internet access are generally considered essential in personal and business life, and accordingly have become universally available in most homes, offices, and other locations in the community. These communication services generally involve one or two-way transmission of a communication signal between a central location, a number of sub-distribution points, and end users. In most cases the final connection between the last local distribution point and the end user is delivered through some sort of physical link such as a wire pair, co-axial cable, or fiber optic cable.

In this arrangement, certain equipment is generally needed at the last local distribution point to serve a group of end users. In dense urban areas many locations are conveniently available to accommodate this equipment. However, in less densely populated areas where end users are spread out, such as suburban subdivisions, there is often no convenient, secure, and sheltered place to install the local distribution equipment. Accordingly the various utilities will often construct free-standing enclosures, known as service panels or pedestals, that are dedicated to house this type of equipment.

Typically, the telephone and cable TV utility providers each independently construct and maintain their own separate pedestals. Depending on the layout of the subdivision, the pedestals may be located on the strip of land between the sidewalk and the road, or alternatively on the edge of user's front lawns, approximately every 3 to 4 lots. The pedestals come in a variety of sizes depending on the amount of equipment being stored, with the smaller pedestals being generally several feet high and under a foot wide. They are often constructed from a metal such as aluminium, or from plastic. Since they are outdoors and free-standing they are accessible to service personnel at any time of the day or night.

The service pedestals however are generally unsightly, being rectangular industrial boxes that clash with the neighborhood aesthetic or front yard landscape. Also, since the boxes are placed by the utilities with only ease of service in mind, they are visually uncoordinated, which exacerbates their unattractive appearance. Further, when installed on private land they deny the land owner use of the space occupied by and in the immediate vicinity of the pedestal. They can be hazardous to children, pets, or others who walk into them without looking, and can hinder recreational or sporting use of the lawn. Lawn maintenance activities such as grass cutting are also clearly obstructed by the pedestals. Yet another problem is that in new subdivisions the pedestals are usually installed before the adjacent house is constructed. As a result, they are occasionally inadvertently destroyed by bulldozers or other construction equipment, necessitating expensive and inconvenient repair or reconstruction.

To the utilities involved, there is an ongoing expense to keep track of and manage access to the many pedestals. Maintenance is also an issue that requires attention, particularly when pedestals are damaged by vehicle collision or vandalism. Further, in some communities in winter, the pedestals with their low profile can be difficult to locate.

An alternate approach involves housing the local communication equipment in "flush to grade" boxes located under the ground. However, this approach creates other problems. For example, water from rain and melting snow can easily seep into the underground boxes, which can damage the equipment. The boxes can be very difficult to locate in winter conditions of ice and snow. Further, even when the boxes are located, the equipment is generally difficult to access since it is below ground.

For these reasons lawn pedestals generally remain the preferred approach. However, in the absence of an effective alternative, the unattractive appearance, inconvenience, safety hazards, and costs associated with lawn pedestals will continue to be a problem.

SUMMARY OF THE INVENTION

What is desired is a means of housing local distribution equipment that overcomes one or more of the problems associated with the current devices and methods, such as lawn pedestals, used for local distribution of utility services.

In particular, it would be preferable if the discrete, dedicated lawn pedestals could be dispensed with entirely or reduced in number. In this way, neighborhood appearance would be improved and the lawn space previously occupied by the pedestals would be recovered for private or community use. Lawn maintenance would be easier and the risks of collision eliminated. Preferably, the equipment will continue to be both readily accessible to utility service personnel and protected in secure, weatherproof housing.

Accordingly, there is provided a multifunction utility pole, comprising:

a base portion suitable for installation in the ground or mounting on a surface, said base portion including a housing for a first utility;

a pole portion extending above said base portion, said pole portion including a fixture for a second utility; and a wiring path extending through said base portion and said pole portion, to provide access for wiring to said second utility;

wherein said utility pole is capable of simultaneously accommodating said first and second utilities.

BRIEF DESCRIPTION OF THE DRAWINGS

Reference will now be made, by way of example only, to preferred embodiments of the invention as illustrated in the attached figures.

DETAILED DESCRIPTION OF THE PREFERRED EMBODIMENTS

Figure 1:
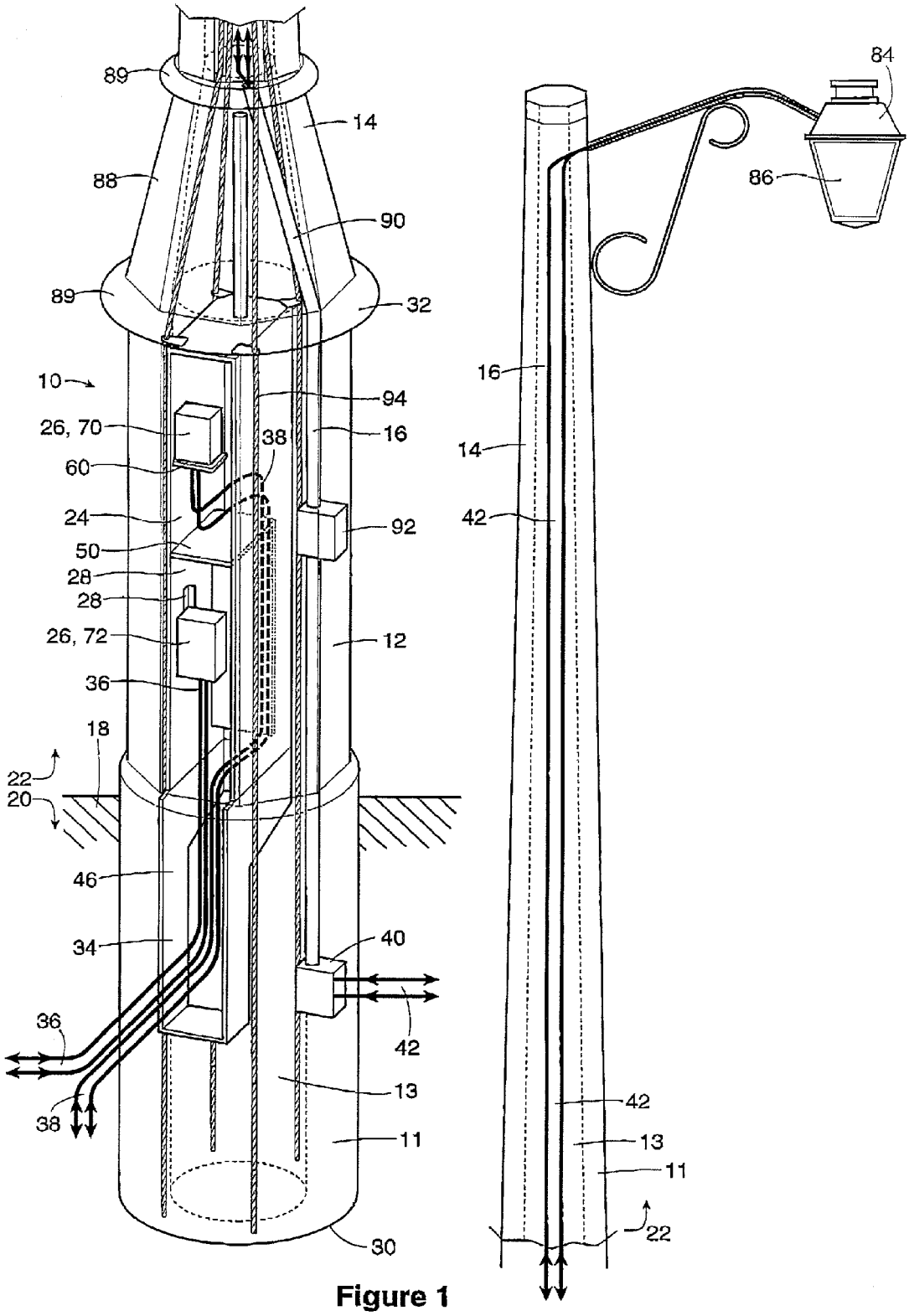
FIG. 1 is a perspective, phantom view of the multifunction utility pole of the present invention, showing the various utility services provided.

The multifunction utility pole of the present invention is shown in FIG. 1, with several elements shown in phantom and exploded view for clarity. The pole is generally indicated with reference numeral 10, and broadly comprises a base portion 12, a pole portion 14, and a wiring path 16. The pole has an outer wall 11 surrounding a hollow interior core 13. It can be seen that the utility pole 10 is installed in the ground 18, and accordingly includes a below-ground portion 20 and an above-ground portion 22.

Figure 7:
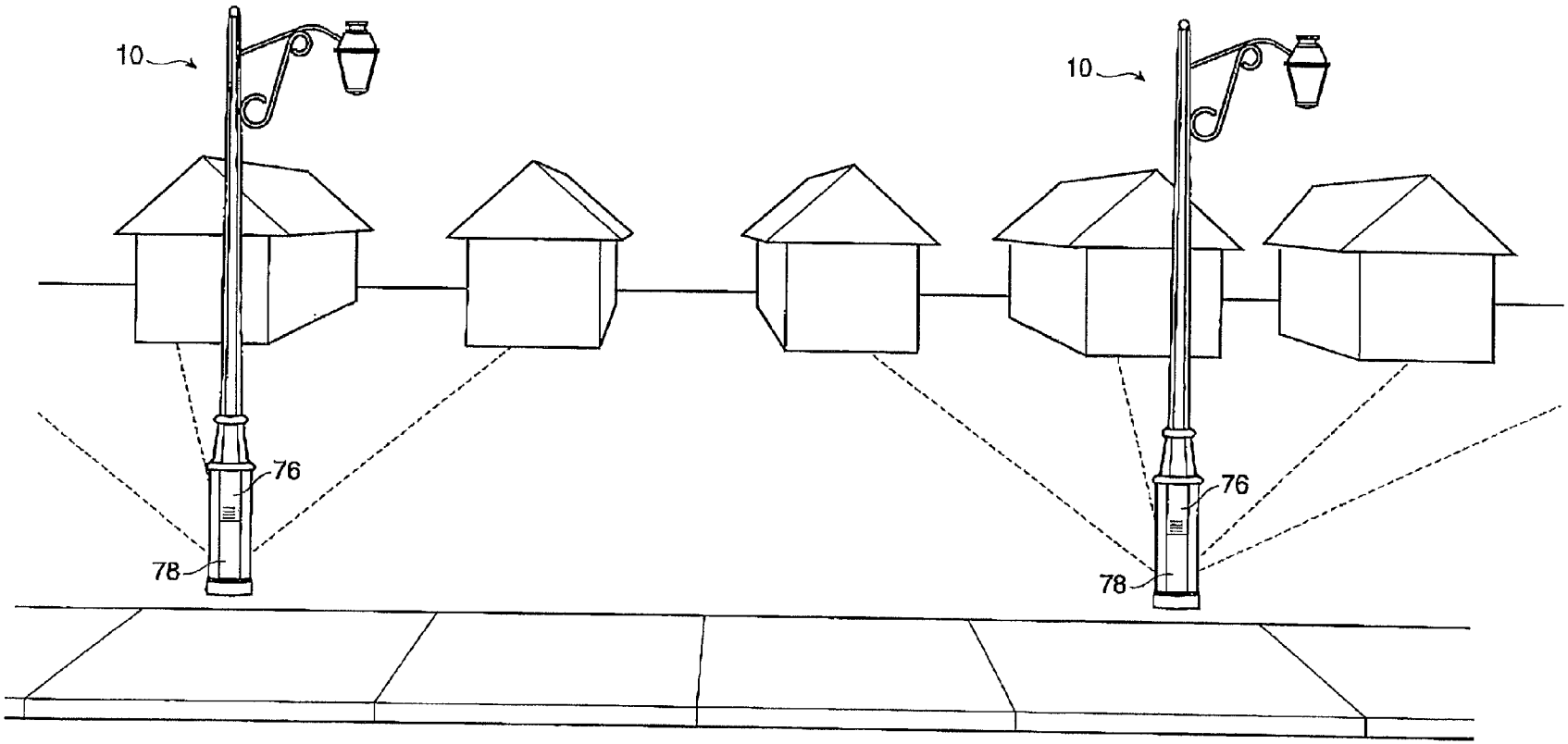
FIG. 7 is a perspective view of a neighborhood subdivision in which the multifunction utility pole of the present invention is installed.

For convenient representation, in order to show sufficient detail, the utility pole of the present invention is shown in two parts in FIG. 1, with the left-side drawing showing a lower part and the right-side drawing showing an upper part of the utility pole 10. For further reference, a view of the pole 10 as a whole is shown in FIG. 7. The multi-function utility pole of the present invention provides the traditional street lighting utility, and as discussed in greater detail below, also includes facilities to provide additional local utility services.

The base portion 12 includes that part of the utility pole 10 that maintains a fixed and secure contact with the ground, in order to support the pole 10. As shown in FIG. 1, this will generally include all of the below-ground portion 20 and part of the above-ground portion 22. Generally, the utility pole 10 is installed below the surface of the ground and is sized and shaped so that the stability provided by the below-ground portion 20 is sufficient to maintain the visible, above-ground portion 22 securely upright, particularly in the face of strong winds or moderate vehicle collision. For example, in the case of a utility pole having an overall height of about 30 feet, it has been found that a below-ground portion of about 5 feet is generally sufficient. The invention also comprehends the less common case of utility poles 10 mounted on a surface, where the pole 10 is entirely above ground and does not have a below-ground portion 20. In that case the base portion 12 will be configured to secure to the surface through some other means, such as, for example, a flange or bracket that accepts bolts attachable to a concrete base.

The base portion 12 also includes a housing or utility box 24 for a first utility 26, and at least a portion of the wiring path 16, This is preferably accomplished by including in the base portion 12 an internal cavity 28 sized and shaped to receive the housing 24 and the wiring path 16. In order to accommodate a housing 24 having sufficient capacity to hold the first utility 26, the base portion 12 should preferably be enlarged relative to the pole portion 14. In this way, the internal cavity 28 within the base portion 12 will accordingly also be larger, providing more room for the housing 24. For example, for the utility pole 10 described above having a height of about 30 feet, it has been found that a base portion having a diameter of about 20 inches is adequate.

It can be appreciated that conventional, single function utility poles are often constructed with a small taper from the base to the upper tip to enhance aesthetics. In a strict sense these poles might also be considered to have an "enlarged" base relative to their upper portion. In the context of the present invention, the enlarged base portion 12 represents a more perceptible expansion in diameter that is clearly related to the necessity to accommodate the housing 24.

It can be appreciated that the invention also comprehends other means by which the base portion 12 can include a housing 24 for a first utility 26. For example, the housing 24 could simply be the internal cavity 28 itself, where the first utility 26 is mounted directly to the inside of the outer wall 11 of the base portion 12, or to a flat plate or bracket rather than a more comprehensive utility box. In any event, it is believed that the embodiment first described, in which a housing or utility box 24 is contained within an internal cavity 28 of an enlarged base portion 12, provides more convenient access for utility service personnel and better protection of the first utility 26. Further, the enlarged base portion 12 has other advantages such as a more stable and secure structural base, and in some cases a more attractive appearance than a conventional tapered pole. For these reasons as noted this embodiment is preferred.

The height of the base portion 12 can now be understood as comprising that portion of the utility pole 10 that extends from the bottom or tip 30 to the point just above the housing 24, shown as 32 in FIG. 1. The pole portion 14 generally comprises the upper part of the pole 10 above point 32.

The base portion 12 preferably also includes at least one access opening to receive utility cables for connection to the first utility 26. FIG. 1 shows a first access opening 34, which provides access to two sets of utility cables 36 and 38. The first access opening 34 is preferably located in the below-ground portion 20 of the utility pole 10 to better receive the utility cables, which are generally laid underground. It can be appreciated that the present invention comprehends other configurations such as the transmission of utility cables above ground, in which case the access openings may be desirably located in the above-ground portion 22 of the pole. Since the utility pole of the present invention is multi-functional and can support at least two utility services, the base portion 12 preferably contains at least two access openings, one for each utility. Accordingly, FIG. 1 shows a second access opening 40 providing access into base portion 12 to a set of utility cables 42. As will be discussed in greater detail, at least one access opening, in particular access opening 40, is preferably sized and shaped to receive utility cables 42 that provide electrical power. Similarly, the other at least one access opening is sized and shaped to receive utility cables 36 and/or 38 that provide communication signals.

Figure 2:
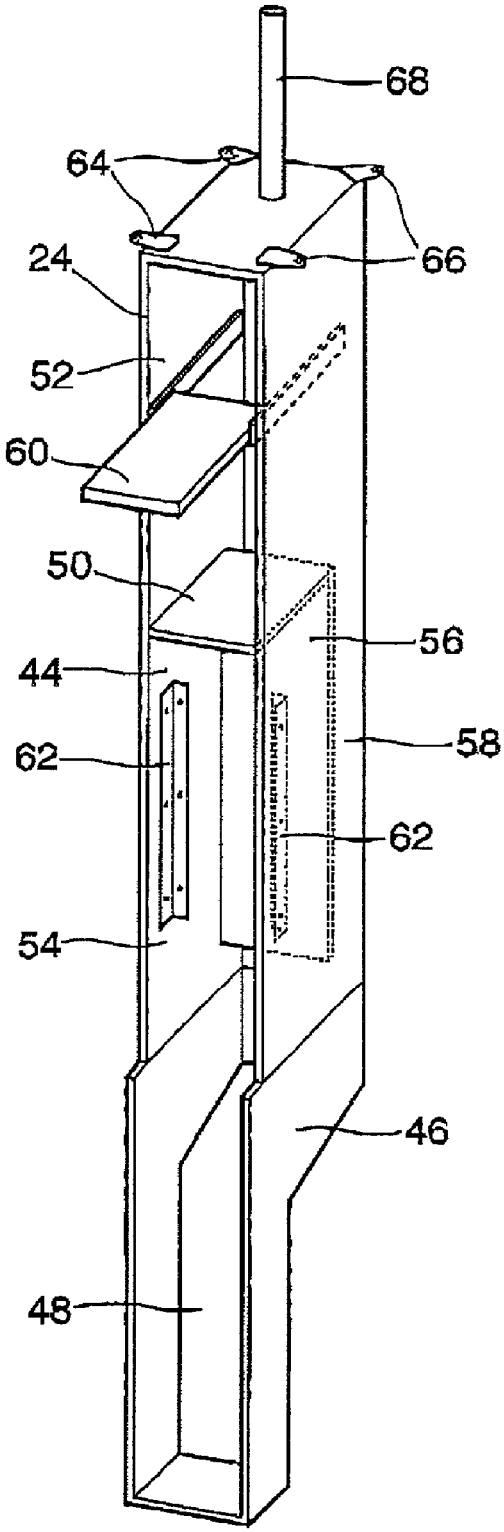
FIG. 2 is a perspective view of the housing of FIG. 1.

The housing or utility box 24 is shown installed in the utility pole 10 in FIG. 1, and also shown isolated, for greater clarity, in FIG. 2. The box 24 is a rigid enclosure preferably constructed from a durable and strong material such as steel or other metal. In particular, it has been found that 14 gauge steel is adequate. It can be seen that the box 24 is generally rectangular, and is closed on three sides with an open front side 44. The top of the box 24 is closed, and the bottom is open and connected to a box extension 46. The box extension 46 is an irregular shaped element having two sides, an open back, and an open front 48. The front 48 of the box extension 46 is flush or in-line with the front 44 of the utility box 24. As will be shown, front sides 48 and 46 lie along an outer surface of the utility pole 10 and thereby provide access openings into the utility pole 10. The box extension may be viewed as an integral part of the housing or utility box 24, or alternatively as an additional element attachable to the utility box 24.

In the preferred embodiment of the utility box 24 there is a separator or platform 50 dividing the interior of the box 24 into upper and lower compartments, designated 52 and 54 respectively. There is also a vertical back wall or separator 56 that runs generally parallel to the back wall of lower compartment 54, approximately two inches away. Separator 56 therefore creates a gap or false wall 58, also called a cable chase access, between the adjacent walls. FIG. 2 also shows a slidable rack 60 in upper compartment 52 and a set of brackets 62 bolted to the sides of lower compartment 54. Rack 60 can be oriented horizontally, as shown, or vertically if desired. It can be appreciated that any one of a rack, brackets, or other means of securing utility equipment can be installed in either compartment as desired. Retainer brackets 64 are shown attached at each corner at the top of the box 24. The retainer brackets 64 are flat tabs or projections having apertures or holes 66 at a tip end overhanging the space adjacent to the utility box 24. Finally, there is a vent stack 68 in the form of a PVC tube projecting out of the top of the utility box 24. The vent stack 68 is preferably about two inches in diameter, and provides a path to dissipate any heat buildup in the interior of the utility box 24.

Turning now to FIG. 1, it can be seen that the first utility 26 is located inside the housing or utility box 24. The utility 26 means the equipment used to provide a utility service to local customers, and in the preferred embodiment generally refers to communication distribution equipment or a communication panel that distributes communication or television signals. Fiber optic based equipment that provides telephone, cable television, Internet access and other services on a single fiber is also comprehended by this invention. The utility 26 therefore comprises the same type of equipment that in the ordinary course is installed in the lawn pedestals described in the background section above.

The first utility 26 can comprise more than one type of distribution equipment, as long as there is sufficient space available in the utility box 24. In the preferred embodiment shown in FIG. 1 there are two utilities 26 provided, an upper utility 70 and a lower utility 72. It can be appreciated that if only one utility 26 was installed, the separators 50 and 56 would not be required. Similarly, the invention also comprehends more than two utilities, for which an alternate configuration of separators would be required.

In order to operate, the equipment comprising first utility 26 must be connected to the cables 36 and/or 38 that carry the utility signals to be distributed. As noted, utility cables are usually laid underground, and therefore are preferably received in the below-ground portion 20 of the utility pole 10. In particular, the box extension 46 is preferably provided for this purpose, to receive the cables directed to the first utility 26. As shown in FIG. 1, utility cables 36 and 38 enter the first access opening 34 provided by the box extension 46. From there, cable set 36 is directed into lower compartment 54, where it is connected to lower utility 72. Similarly, cable set 38 is directed upwards, in the cable chase access 58 behind vertical back wall 56, to upper compartment 52 where it is connected to upper utility 70.

In the preferred embodiment of the invention, upper utility 70 is cable television equipment and lower utility 72 is a telephone terminal panel. Accordingly, cable set 36 represents telephone cables and cable set 38 represents cable television cables. This arrangement is preferred because telephone cables 36 are generally very thick and inflexible, often containing hundreds of pairs of wire in bundles as much as three inches thick. By placing the telephone equipment in lower compartment 54, the degree of manoeuverability required to connect the telephone cables 36 is reduced.

It can also be appreciated that the open front 48 of the box extension 46 facilitates the insertion and manipulation of the cables. The invention comprehends other means of inserting cables into utility pole 10, such as, for example, pVC conduits that project out of the bottom of the box 24 and that individually connect to compartments 52 and 54. However, it was found that manipulating thick, inflexible telephone cables through a conduit was often a difficult or time consuming procedure. Accordingly, the open approach provided by the box extension 46 is preferred.

Figure 3:
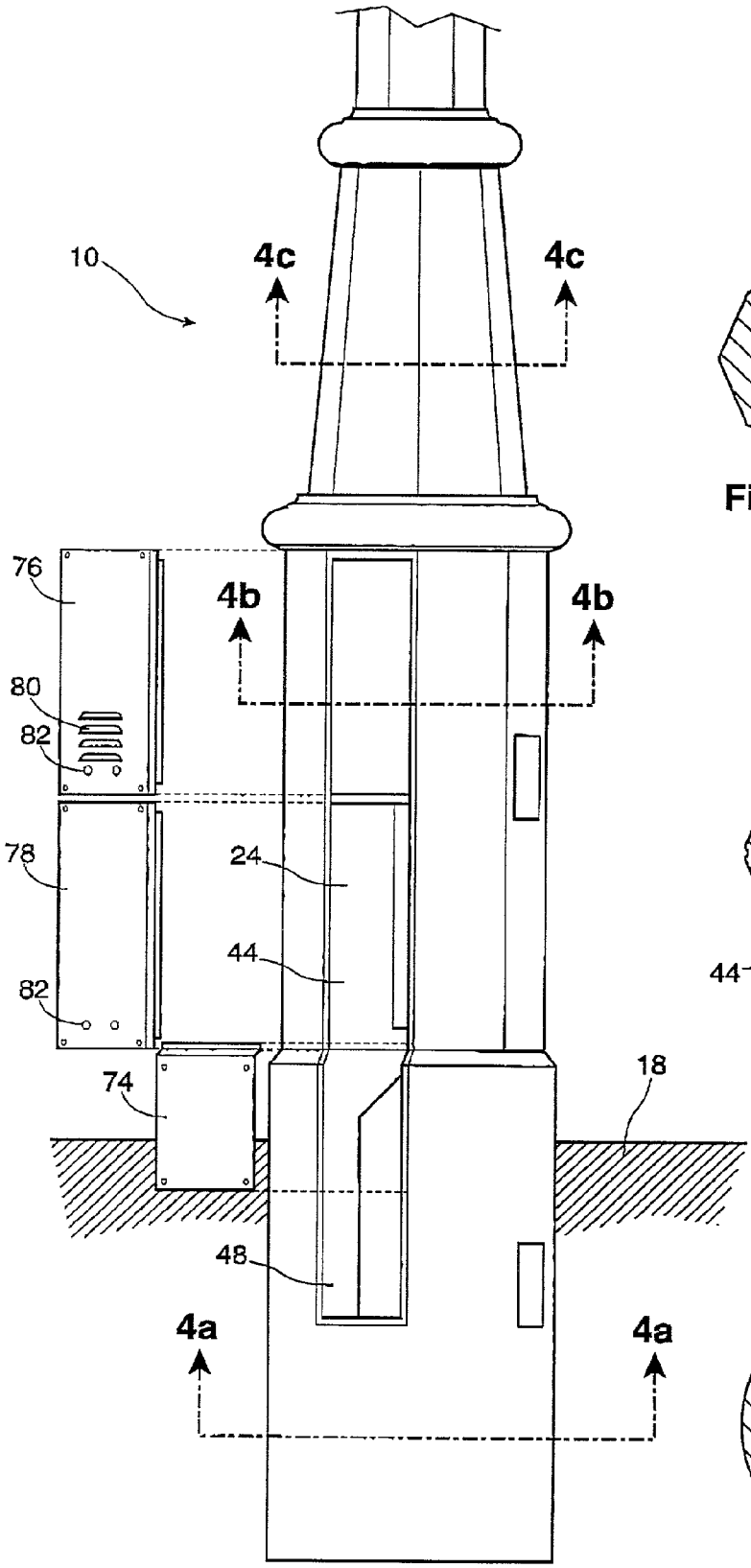
FIG. 3 is a front view of the multifunction utility pole of FIG. 1, showing the various surface apertures in the finished pole.

FIG. 3 shows the utility pole 10 of the present invention installed in the ground 18 with the various access openings shown. Several access opening covers are also shown in exploded view. There is a box extension cover 74 that covers an upper part of the box extension 46, and in particular any part that is above the ground 18. The cover 74 would generally be bolted on and remain permanently installed, since it would not need to be removed in the ordinary course once the cables to the first utility 26 are connected. A lower part of the front side 48 of box extension 46 is underground and left open in the preferred embodiment. It can be appreciated that if desired, cover 74 could be lengthened to cover all of front side 48, or a second cover could be provided.

The utility box 26 also has a cover 76, or in the preferred embodiment two covers 76 and 78, to permit access to the first utility 26. As shown in FIG. 3, upper cover 76 protects upper compartment 52 and lower cover 78 protects lower compartment 54, to permit access to the cable television or upper utility 70 and telephone or lower utility 72 respectively. The invention comprehends various means of attaching and securing the covers to the compartments, including camlocks, padlocks, bolts, hinged doors, or other means familiar to persons skilled in the art. A vent 80 is usefully provided in the covers 76 or 78. Additionally, holes 82 in the covers may be provided as shown to permit a temporary line connection to be made during servicing. This feature is particularly useful to restore temporary service quickly without having to dig a trench when an underground line has been cut.

Figure 4C:
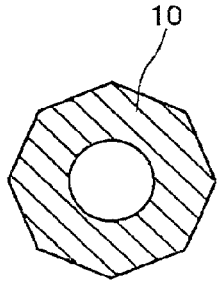
FIGS. 4*a*, 4*b*, and 4*c* are cross-sectional views taken at different points of the multifunction utility pole of FIG. 3.
Figure 4B:
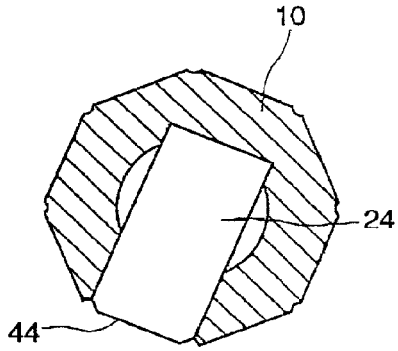
Figure 4A:
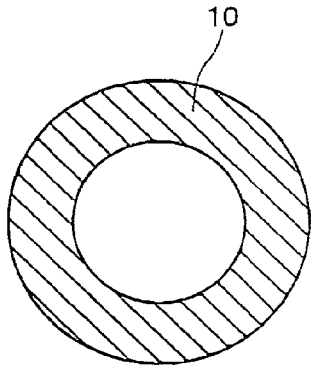

A further view of the multifunction utility pole 10 of the present invention may be seen in FIGS. 4*a*, 4*b*, and 4*c*, which show various cross-sectional views. FIGS. 4*a* and 4*c* are views taken at positions above and below the utility box 24 respectively, and accordingly show an unobstructed cross-section of the inner wall with a hollow core. FIG. 4*b* shows the position of the utility box 24 within the pole 10. It can be seen that the front of the utility box 24 occupies a portion of the space otherwise occupied by the wall of the pole 10. The rear portion of the box 24 is mostly accommodated by the otherwise unused hollow core 13, with the back edges of the box 24 abutting the outer walls 11. The front side 44 of the utility box 24 faces the outside surface of the pole 10, and is accordingly accessible upon removal of covers 76 and 78.

The pole portion 14 of the utility pole 10 extends above the base portion 12, and includes a fixture 84 for a second utility 86. In the preferred embodiment of the invention the second utility 86 is a lamp or other lighting appliance used to provide the traditional function of street lighting. However, the invention also comprehends other services for the second utility 86 such as, for example, a high mount camera to provide traffic information, or a cellular telephone repeater. As with the first utility 26, more than one utility service or function may be provided by the second utility 86.

When used to provide street lighting, the lamp used as second utility 86 is preferably approximately 25 feet above the ground. For this application a utility pole approximately 30 feet high, of which 5 feet comprise the below-ground portion 20 and 25 feet comprise the above-ground portion 22 has been found to be adequate. A preferable set of dimensions for the utility box 24 in this pole 10 is about 44 inches high, 9.5 inches wide, and 12 inches deep. Similarly, the box extension 46 is preferably about 36 inches high. If the utility box 24 is positioned 6 inches above the ground 18, the base portion 12 would be about 9 feet high, extending from the bottom 30 of the pole 10 to the point 32 above the utility box 24. For the box area dimensions of 9.5 inches wide by 12 inches deep, the diameter of the base portion 12 would preferably be about 20 inches.

It can be appreciated that it would be inefficient and costly to maintain the base portion diameter constant through the pole portion. Accordingly, it is preferable to construct the pole portion diameter at its conventional width of approximately 9.5 inches in diameter, tapering gradually to about 6 inches diameter at the top of the pole 10. In order to effect the transition from the wide 20 inch diameter base portion 12 to the relatively narrower diameter generally prevalent in the pole portion 14, a transition section 88 comprising a base or first part of the pole portion 14 is preferably provided. In the preferred embodiment of FIG. 1, the transition section 88 is approximately 2 feet, 10 inches high, and preferably includes thicker ring sections 89 at its top and bottom for decorative appearance.

The wiring path 16 provides access for wiring to the second utility 86. As shown in FIG. 1, the wiring path 16 extends from the point of entry of the utility or electrical power cables 42 into the utility pole 10 at the second access opening 40, through the base portion 12 and pole portion 14, to the lamp or second utility 86.

It can be appreciated that within the base portion 12 the hollow core 11 is largely occupied by the housing or utility box 24. Accordingly, within the base portion 12 the wiring path 16 preferably comprises a conduit 90 that generally runs outside of the housing 24. More particularly, between the second access opening 40 and the top of the housing 24 at point 32, the conduit 90 runs within the outer wall 11 of the pole 10 or alternatively within the hollow core 13, along side the housing 24. In order to reduce the risk of a short circuit or other electrical disturbance, the wiring path 16 is preferably electrically isolated from the housing 24. This can be achieved by configuring the wiring path 16 or conduit 90 so that it does not make contact with the utility box 24, and also by using a conduit 90 that is an electrical insulator. It can be appreciated that other means of achieving electrical isolation are also comprehended by the present invention.

Once past the utility box 24 the hollow core 13 is empty. Accordingly, the wiring path 16 can be offset around the housing 24 inside the base portion 12, so that is angled towards the center of the pole 10. As shown in FIG. 1, the transition section 88 of the pole portion 14 provides a convenient segment within the utility pole 10 in which the conduit 90 can be offset. When the conduit 90 reaches the center it can terminate. From there the utility cables 42 can continue freely inside the pole portion 14, within the raceway created by the hollow core 13, to the top of the pole where they can be connected to the lamp or second utility 86. Accordingly, in the preferred embodiment the wiring path 16 comprises the conduit 90 in the base portion 12, and a raceway or hollow core 13 in the pole portion 14.

The conduit 90 is preferably constructed of PVC plastic or other material that is durable, strong, and lightweight. As noted, the material is preferably also an electrical insulator. The diameter of the conduit 90 is preferably about 2 inches, or generally sufficiently large to accommodate the utility cables 42. A handhole frame or splice box 92 is preferably provided in the path of the conduit 90. In practice, heavy duty cables 42 that run underground enter the pole 10 at the second access opening 40 and pass through the conduit 90 to splice box 92. There, the heavy duty cables 42 can be conveniently spliced with a lighter, less costly gauge of cable 42 that run up to the lamp 86.

In this way, through use of an electrically isolated wiring path that is offset from the housing in the base portion, the utility pole of the present invention can accommodate both the first utility 26 contained in the housing 24 and the wiring path 16 required to fulfill the operation of the second utility 86. It can be appreciated that other means by which the first utility 26 and wiring path 16 coexist within the utility pole 10 are also comprehended by the scope of the invention.

The utility pole 10 of the present invention is preferably constructed from concrete. This material has the advantages of being durable, strong, weather resistant, and cost effective. In addition, as will be described below, concrete poles can be readily fabricated to have an enlarged base with an internal cavity suitable for containing the utility box 24 of the preferred embodiment. However, it can be appreciated that the present invention comprehends the use of other strong and durable materials, such as metal or plastic for example, provided they can be similarly configured to contain the key elements of the invention.

Figure 5:
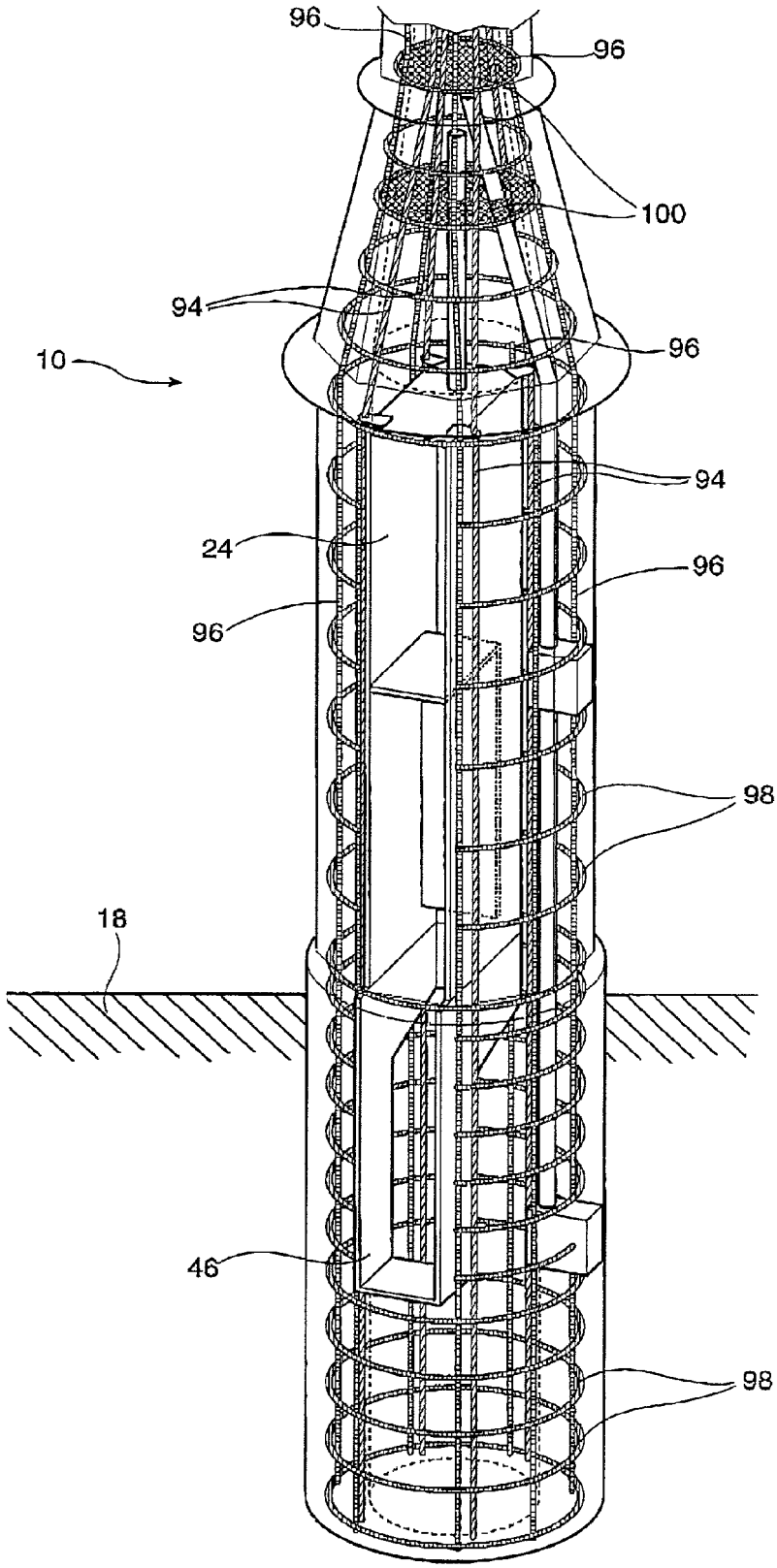
FIG. 5 is another perspective, phantom view of the multifunction utility pole of FIG. 1, showing the structural features of the invention.

FIG. 5 is a phantom view of a concrete pole showing, in hidden view, some of the elements commonly used to provide structural strength and integrity to the finished pole 10. These elements include reinforcing cables or steel strands 94 that are installed under very high tension and extend the full length of the pole 10. Reinforcing or "rebar" rods 96 are also often included. These rods run parallel with the reinforcing cables and add extra reinforcement, usually for a distance approximately corresponding to the base portion 12. Also shown is helical wire in the form of circular loops 98 which form a series of rings around at least a portion of the pole 10 to provide torsional reinforcement. All of these structural elements are positioned within the concrete outer wall 11 of the pole 10 in order to impart tensile or torsional strength.

It can be seen from FIG. 5 that the reinforcing cables or steel strands 94 run straight up along the sides of the outer walls 11 of the base portion 12 and are then offset or angled inward, around the utility box 24, so that they follow the contour of the pole 10 as it narrows. Preferably the reinforcing cables 94 pass through the apertures 66 in the retainer brackets 64 located at the top of utility box 24. Given the enlarged base portion 12 and narrower pole portion of the present invention, it can be appreciated that the high tension applied to the reinforcing cables would tend to urge the cables inwards within the base portion 12. This is undesirable, as it could result in drawing the reinforcing cables 94 outside the outer walls 11 and into the hollow core 13 of the pole. Accordingly, by providing a fixed position through which the reinforcing cables are offset around the utility box 24, the retainer brackets 64 help to maintain the reinforcing cables fixed within the outer walls 11. It can now also be appreciated that another advantage of the preferred embodiment is that it includes the utility box 24, which provides a convenient platform on which the retainer brackets 64 can be mounted.

From FIG. 5 it can be seen that some of the reinforcing rods 96 are also offset to follow the contour of the pole.

However, the rods 96 are sufficiently stiff and malleable that they can be bent in advance to angle inward. Therefore, unlike the overly flexible reinforcing cables 94, the reinforcing rods 96 do not need a positioner such as the retainer brackets 64 to be properly positioned inside the utility pole 10.

Above the utility box 24, one or more circular rings 100 are preferably provided through which the reinforcing cables 94 may be threaded. The circular rings 100 further guide the reinforcing cables 94 and fixes them within the outer walls 11 of the pole 10. As shown in FIG. 5, the circular rings 100 can also be used to help guide and stabilize the offset conduit 90 and vent stack 68. It can also be seen in FIG. 5 that the helical wires 98 that intersect the utility box 24 and box extension 46 are modified to terminate at a reinforcing cable 94 or reinforcing rod 96, rather than continue as a full loop. In this way the front side 44 of the utility box 24 and front side 48 of the box extension 46 remain open and unimpeded.

It can accordingly be appreciated that the utility pole 10 of the present invention, having an enlarged base portion and an internal housing holding a first utility, continues to maintain its structural integrity and strength.

Figure 6A:
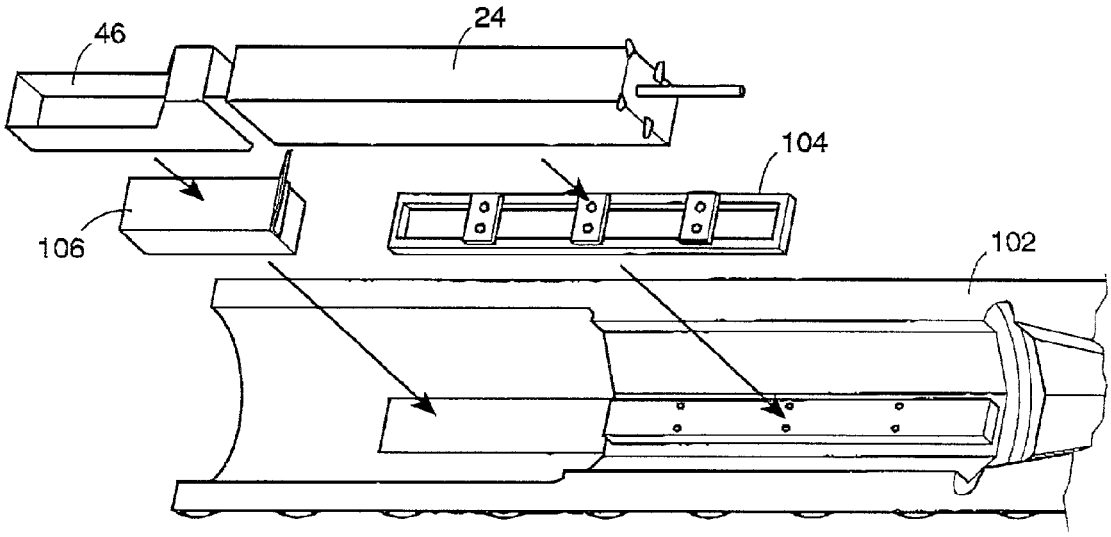
FIG. 6*a* is an exploded view of a mold and associated equipment used to manufacture the multifunction utility pole of FIG. 1.
Figure 6B:
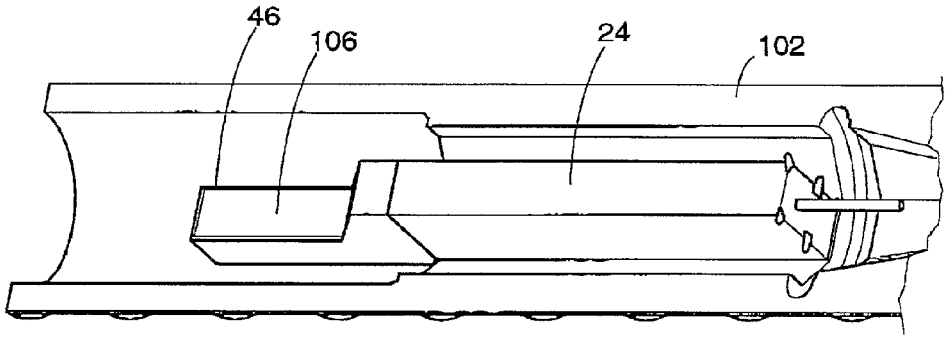
FIG. 6*b* is a perspective view of the elements of FIG. 6*a* installed in the mold.
Figure 6C:
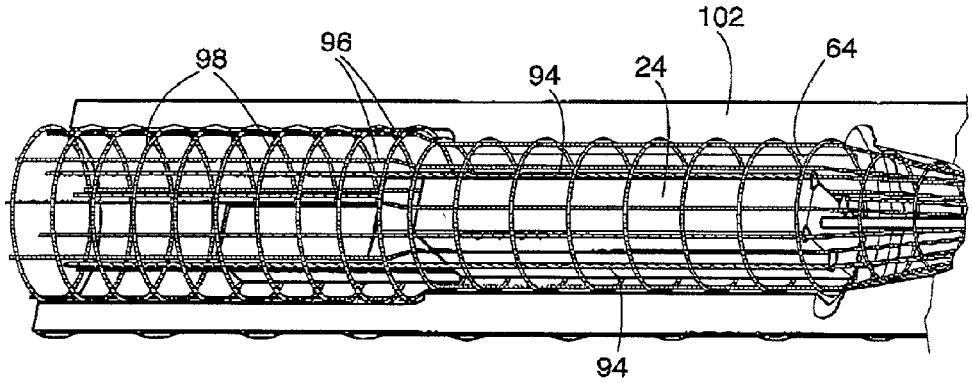
FIG. 6*c* is a perspective view of FIG. 6*b* after installation of the structural elements of the utility pole.

A method by which the concrete multifunction utility pole of the present invention can be manufactured is shown in FIGS. 6*a* to 6*c*. FIG. 6*a* shows a mold 102 of the type commonly used in the production of concrete poles. The mold 102 is sized and shaped to have a base portion 12 and pole portion 14, with an internal cavity 28 sized and shaped to receive a housing 24 in accordance with the present invention. For clarity, the utility box 24 and box extension 46 are shown in exploded view above the mold 102. Also shown are two additional elements used specifically in the production process, a mounting plate 104 and box extension blockout 106.

FIG. 6*b* shows the mold 102 after installation of the various elements, including installing the utility box 24 in the internal cavity 28. The mounting plate 104, hidden in FIG. 6*b*, occupies the space corresponding with the front side 44 of utility box 24. The mounting plate 104 therefore prevents concrete from flowing to the front side 44 of box 24, so that box 24 remains open and accessible. It also functions to provide a counterweight that helps keep the mold 102 balanced during the spinning process, described below. The mounting plate 104 is accordingly preferably made from a heavy steel plate or other metal, in order to act as an effective barrier to concrete and act as a counterweight. The box extension blockout 106 occupies the space inside the box extension 46, and thereby functions to prevent concrete from accumulating inside the box extension. The box extension blockout 106 is accordingly preferably made from a material that effectively blocks concrete, such as metal or plastic.

In FIG. 6*c* the reinforcing cables 94 are shown installed, extending from the base portion 12 to the pole portion 14. The reinforcing cables 94 pass through the retainer brackets 64 and are accordingly offset around the utility box 24. The other structural features such as the reinforcing rods 94 and helical wires 98, as well as the conduit 90 of the wiring path 16, are also installed in FIG. 6*c*. This figure also shows a variation in which the structural features have two different widths within the base portion 12. It can be appreciated that each shift in width would require at least one additional set of retainer brackets 64 or similar positioner to offset the reinforcing cables 94. As noted, the preferred embodiment is to maintain a uniform width within the base portion 12, with an offset at the top of the utility box 24.

In the next step of the manufacturing process, flowable concrete is poured into the mold 102, and the mold is closed by bolting it to its upper half. The reinforcing cables 94 are then prestressed under very high tension, and the mold is spun for a predetermined time until the concrete takes the shape of the mold. The spinning of the mold forces the concrete to the outside by centrifugal force, so that it forms a pole having an outer wall 11 and hollow interior core 13. Then, when the concrete has hardened the mold 102 is removed and the pole 10 becomes available for use.

Installation of the finished pole 10 can be described with reference to FIG. 3. A hole is made in the ground 18 to a depth sufficient to bury the below-ground portion 20 of the pole. To provide worker access, the hole is initially made wider than the base portion 12 of the pole. The various underground utility cables are brought up to the pole 10 for installation. The electric power utility cables 42 are passed through second access opening 40 and up through conduit 90 to splice box 92. There they are spliced with a lighter utility cable 42 which continues to the fixture 84 at the top of the pole 10. The cable television cables 38 are pushed through the box extension 46, up the cable chase access 58, and connected to the cable television equipment 70 installed in the upper compartment 52. The telephone cables 36 are pushed into the box extension 46 and up into the lower compartment 54, where they are connected with the telephone terminal panel 72. The covers 74, 76, and 78 are then installed, to cover the box extension 46 and upper and lower compartments of the utility box 24. The hand hole frame 92 also has a cover (not shown), which is also installed.

In operation, electric power is provided to the lamp or second utility 86 through electric power cables 42. At the same time, the first utility 26 receives and processes communication signals. As noted, the first utility 26 preferably includes two utilities, for telephone and cable television. Accordingly, it can be appreciated that the utility pole of the present invention is capable of simultaneously accommodating the first and second utilities, or at least two utilities overall.

Service access to the installed pole 10 is readily available through the removable front covers 76 and 78. The invention comprehends the use of different locks for each cover. In this way, the cable television workers, for example, could only unlock the top cover 76 and not have access to the telephone equipment protected by lower cover 78.

It can be appreciated that the utility pole of the present invention facilitates and lowers the cost of maintenance for the utilities involved, since fewer dedicated lawn pedestals need to be constructed and maintained. The utility poles 10 can be more easily located and accessed, particularly in the winter when the much shorter lawn pedestals may be obscured by snow. The utility poles also generally have a longer life than the pedestals, particularly compared with those pedestals made from plastic. Further, the utility poles provide better protection against vandalism and accidental collision.

A streetscape or neighbourhood making use of the present invention is shown in FIG. 7. The utility poles 10 provide communication services to end users in the adjacent buildings (indicated by the dotted lines), as well as street lighting. Accordingly, it can be appreciated that the present invention also provides a method of providing communication services to a neighborhood of consumers. The method involves providing a multifunction utility pole having a utility fixture and communication equipment. The communication equipment has a predetermined capacity, for example, an ability to handle the communication connections for 8 houses. The method further involves connecting a communication cable from the communication equipment in the pole to a proximate communication consumer, and repeating this step until the communication equipment reaches its predetermined capacity.

Figure 8:
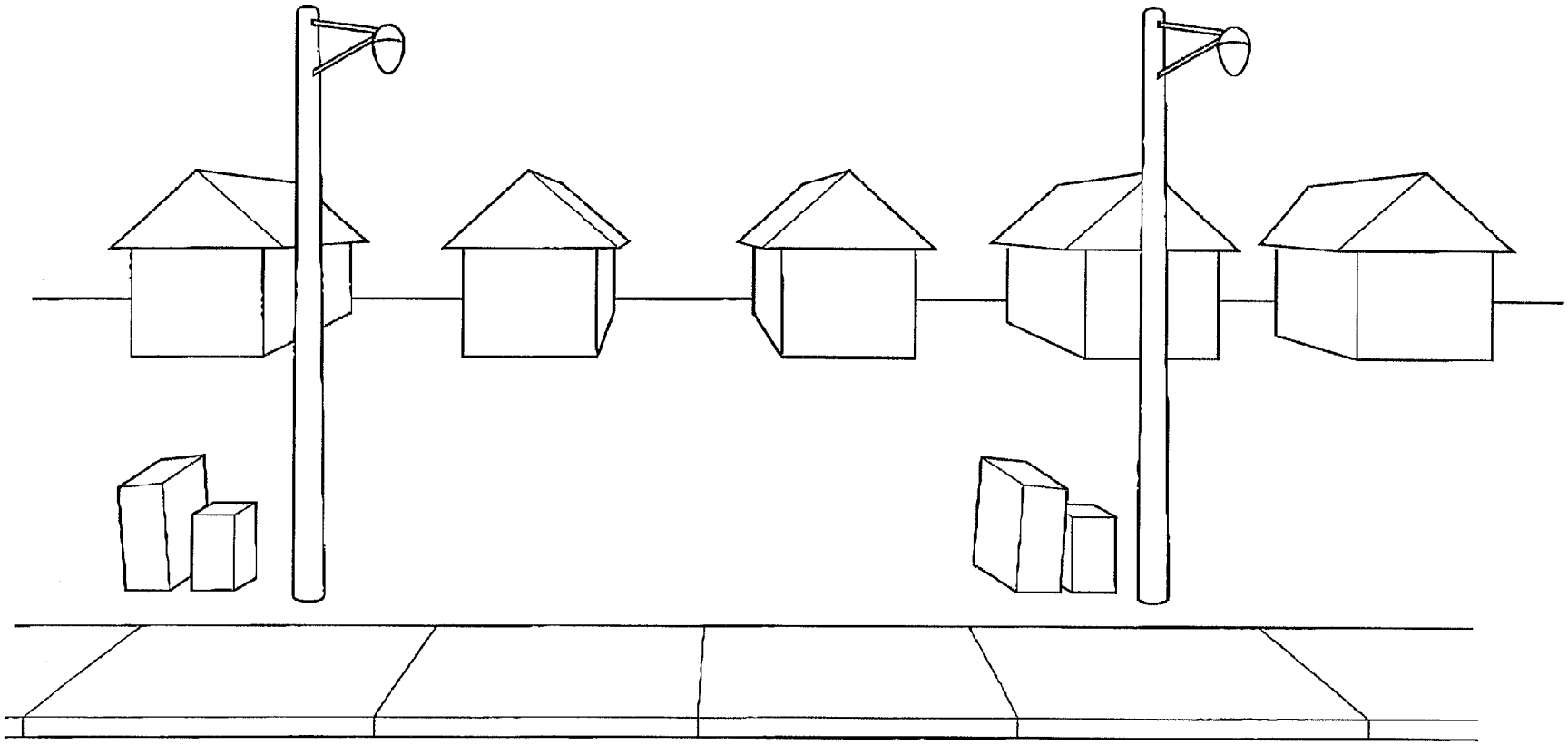
Figure 8 PRIOR ART
FIG. 8 is a perspective view of a neighborhood subdivision showing the utility poles and lawn pedestals of the prior art.

The benefits of the present invention in enhancing the streetscape of a neighborhood are apparent from FIG. 7, and particularly in comparison with FIG. 8, which shows a streetscape having conventional utility poles and lawn pedestals of the prior art. The unsightly, cluttered look of the lawn pedestals is absent in FIG. 7. The lawn space occupied by the pedestals has been reclaimed, so that obstacles to lawn mowers and other maintenance activities are removed. The streetscape of FIG. 7 is also safer, since there are fewer potential objects presenting a risk of collision to pedestrians, vehicles, or construction equipment.

It will be appreciated by those skilled in the art that the foregoing description was in respect of preferred embodiments and that various alterations and modifications are possible within the broad scope of the appended claims without departing from the spirit of the invention. For example, while reference is made to a utility pole having a wiring path separate from the housing in the base portion, the housing could also be configured to include an integrated wiring path or conduit. Various other modifications will be apparent to those skilled in the art but are not described in any further detail herein.

The invention claimed is:

1. A multifunction utility pole, comprising:

(a) a reinforced concrete base portion suitable for installation in the ground or mounting on a surface, said base portion including an internal cavity sized and shaped to accommodate at least a first utility;

(b) a reinforced concrete pole portion extending above said base portion, said pole portion for supporting at least a second utility; and (c) an electrically isolated wiring path extending through said base portion and said pole portion, to provide access for wiring to said second utility;

wherein said utility pole is capable of simultaneously accommodating said first and second utilities.

2. The utility pole according to claim 1, further including a housing located in said internal cavity, to accommodate at least said first utility.

3. The utility pole according to claim 2, wherein said base portion includes at least one access opening to receive utility cables.

4. The utility pole according to claim 3, wherein said base portion includes a below-ground portion, and said at least one access opening is in said below-ground portion.

5. The utility pole according to claim 3, wherein said base portion contains at least two access openings, wherein one access opening is sized and shaped to receive electrical power cables and the other at least one access opening is sized and shaped to receive communication signal cables.

6. The utility pole according to claim 5, wherein said housing further includes a box extension, and said access opening to receive said communication signal cables is located in said box extension.

7. The utility pole according to claim 2, wherein said housing comprises a utility box, and said first utility is located inside said utility box.

8. The utility pole according to claim 7, wherein said utility box includes a slidable rack, and said first utility is installed on said slidable rack.

9. The utility pole according to claim 7, wherein said utility box has a cover to permit access to said first utility.

10. The utility pole according to claim 7, wherein said utility box is a rigid enclosure constructed from 14 gauge steel.

11. The utility pole according to claim 2, wherein said wiring path is offset around said housing inside said base portion.

12. The utility pole according to claim 2, wherein said utility pole contains reinforcing cables, and wherein said reinforcing cables are offset around said housing inside said base portion.

13. The utility pole according to claim 12, further including retainer brackets to guide said offset reinforcing cables around said housing.

14. The utility pole according to claim 13, wherein said retainer brackets are attached to said housing.

15. The utility pole according to claim 1, wherein said base portion is enlarged relative to said pole portion.

16. The utility pole according to claim 1, wherein said wiring path provides a path for electrical power cables to provide electrical power to said second utility.

17. The utility pole according to claim 1, wherein said wiring path comprises a conduit in said base portion and a raceway in said pole portion.

18. The utility pole according to claim 1, further including a second utility comprising a street lamp.

19. The utility pole according to claim 1, further including a first utility comprising a communication panel that distributes communication or television signals.

20. A multifunction utility pole, comprising:

(a) a reinforced concrete base portion suitable for installation in the ground or mounting on a surface;

(b) a housing, located inside said base portion, said housing being sized and shaped to accommodate at least a first utility;

(c) reinforcing cables offset around said housing;

(d) a reinforced concrete pole portion extending above said base portion, said pole portion for supporting at least a second utility; and (e) an electrically isolated wiring path extending through said base portion and said pole portion, to provide access for wiring to said second utility;

wherein said utility pole is capable of simultaneously accommodating said first and second utilities.

21. A multifunction utility pole, comprising:

(a) a base portion suitable for installation in the ground or mounting on a surface, said base portion including a housing for a first utility, said housing comprising a utility box having a slidable rack, and said first utility being located inside said utility box and installed on said slidable rack;

(b) a pole portion extending above said base portion, said pole portion including a fixture for a second utility; and (c) a wiring path extending through said base portion and said pole portion, to provide access for wiring to said second utility;

wherein said utility pole is capable of simultaneously accommodating said first and second utilities.

* * * * *